US011787607B2

(12) United States Patent
Jung et al.

(10) Patent No.: US 11,787,607 B2
(45) Date of Patent: Oct. 17, 2023

(54) DRINKING CUP

(71) Applicant: b.box for kids developments Pty Ltd, Mulgrave (AU)

(72) Inventors: Mayer Charles William Jung, Crestmead (AU); Lisa Edlund Tjernberg, Mulgrave (AU); Sylvain Jacques Amatoury, Mulgrave (AU); Ty Gerard Hermans, Crestmead (AU); Navin Chandrakanth Chandrasekaran, Crestmead (AU)

(73) Assignee: b.box for kids developments Pty Ltd, Notting Hill (AU)

( * ) Notice: Subject to any disclaimer, the term of this patent is extended or adjusted under 35 U.S.C. 154(b) by 316 days.

(21) Appl. No.: 17/292,093

(22) PCT Filed: Nov. 26, 2019

(86) PCT No.: PCT/AU2019/051293

§ 371 (c)(1),
(2) Date: May 7, 2021

(87) PCT Pub. No.: WO2020/107064

PCT Pub. Date: Jun. 4, 2020

(65) Prior Publication Data

US 2021/0394975 A1 Dec. 23, 2021

(30) Foreign Application Priority Data

Nov. 30, 2018 (AU) ..... 2018904571

(51) Int. Cl.
*B65D 47/12* (2006.01)
*A47G 19/22* (2006.01)
(Continued)

(52) U.S. Cl.
CPC ..... *B65D 47/126* (2013.01); *A47G 19/2272* (2013.01); *B65D 43/0229* (2013.01);
(Continued)

(58) Field of Classification Search
CPC ... A45F 3/16; A47G 19/2266; A47G 19/2272; A47G 2200/04; B65D 2251/20;
(Continued)

(56) References Cited

U.S. PATENT DOCUMENTS 4,184,603 A 1/1980 Hamilton, Sr.
3,453,870 A1 6/2013 Berg
(Continued)

FOREIGN PATENT DOCUMENTS

CN 1326325 A 12/2001
CN 102970902 A 3/2013
(Continued)

*Primary Examiner* — John K Fristoe, Jr.
*Assistant Examiner* — Madison L Poos
(74) *Attorney, Agent, or Firm* — Young Basile Hanlon & MacFarlane, P.C.

(57) ABSTRACT

A drinking cup includes a container and a detachable closure. The closure has a connection end for connection to the container, the connection end being open for receipt of liquid from within the container. The closure has a closed end opposite the connection end and a drinking rim formed at the peripheral edge of the closed end. The closure has a side wall extending between the connection end and the closed end, and at least one opening that facilitates the passage of liquid from within the container to the drinking rim. A seal is supported by the closure and extends around an outside surface of the side wall, sealing the drinking rim against the passage of liquid through the drinking rim. The seal is flexible and responsive to pressure to lift away from the drinking rim to allow passage of liquid through the drinking rim for drinking from the cup.

20 Claims, 6 Drawing Sheets

(51) Int. Cl.
*B65D 43/02* (2006.01)
*B65D 47/14* (2006.01)

(52) U.S. Cl.
CPC ..... *B65D 47/142* (2013.01); *B65D 2251/20* (2013.01); *B65D 2543/00046* (2013.01); *B65D 2543/00092* (2013.01)

(58) Field of Classification Search
CPC .. B65D 2543/0046; B65D 2543/00092; B65D 43/0229; B65D 47/06; B65D 47/0823; B65D 47/126; B65D 47/142; B65D 47/40
USPC ..... 220/703, 711, 713, 714, 719
See application file for complete search history.

(56) References Cited

U.S. PATENT DOCUMENTS

| | | | | |
|---|---|---|---|---|
| 2009/0039094 | A1 | 2/2009 | Seddon | |
| 2015/0102032 | A1 | 4/2015 | Dunn et al. | |
| 2016/0106242 | A1* | 4/2016 | Dunn | A47G 19/2272 220/719 |
| 2021/0394975 | A1 | 12/2021 | Jung et al. | |

FOREIGN PATENT DOCUMENTS

| | | | | |
|---|---|---|---|---|
| CN | 103974646 | A | 8/2014 | |
| CN | 204635858 | U | 9/2015 | |
| CN | 205433101 | U | 8/2016 | |
| CN | 108495580 | A | 9/2018 | |
| GB | 2564758 | A * | 1/2019 | A47G 19/2272 |
| WO | WO-2019118004 | A1 * | 6/2019 | A45F 3/16 |

* cited by examiner 10
35
34
38
36
30
27
29
13
17
41
40
V
39
31
37
14
12
15
28
26
25
22
16
21
11
20

35
34
41
38
36
A
C
10
13
17
40
37
14
V
39
15
23
28
25
16

DRINKING CUP

PRIORITY CROSS-REFERENCE

This application is a national stage 371 application of PCT/AU2019/051293, filed on Nov. 26, 2019, which claims priority to Australian Provisional Patent Application No. 2018904571, filed Nov. 30, 2018, the contents of which are incorporated into this specification by this reference.

TECHNICAL FIELD

The present invention relates to a drinking cup, in particular for children of a toddler age and which has a construction for limiting leakage or spillage of liquid from the cup if the cup is dropped or knocked over. While the present invention will be described in relation to its use by children of a toddler age, it is to be appreciated that cups according to the invention can be used by anyone of any age that wishes to utilise the leakage and spillage preventative construction of the cups, including able bodied persons as well as handicapped persons, such as persons with limited physical dexterity.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Drinking cups for children of a toddler age must take into account the reduced control and dexterity available to such users of the cup and need where possible, to offer spillage control, so that when the cup is dropped or knocked over, spillage or leakage is eliminated or at least minimised. Drinking cups for children of a toddler age can also be designed so as to facilitate transition to a regular or standard form of cup, which is open and in which a user can drink from any position along the rim of the cup.

Various forms of so-called "no spill" drinking cups are already available. U.S. Pat. No. 8,453, 870 discloses a cup that has a removable cap through which liquid within the cup can be drunk. The cap has a circular side wall that extends to a drinking rim and a concave splash guard inboard of the rim and which includes openings through which liquid flows for drinking. A seal is mounted centrally of the splash guard and extends radially to and engages the rim to prevent flow of liquid past the rim. However, the seal is flexible, so that suction pressure applied to the rim by a child drinking from the cup lifts the seal at the section of the rim that the child is drinking from and liquid can flow past the seal at that section.

U.S. Pat. No. 9,241,588 discloses a similar "no spill" drinking cup but includes a different arrangement for connecting the seal to the splash guard of the cap. It is the splash guard that includes passages for liquid flow and it is the seal that seals against the drinking rim of the cap and which is lifted upon suction pressure.

US 20180008096 discloses a "no spill" drinking cup but rather than including a splash guard, the application discloses a flexible membrane that extends radially across the cap and that itself includes openings for the passage of liquid. The seal extends to the rim of the cap and operates in a similar manner to the prior art discussed above, in that the seal lifts away from the rim in the region where suction pressure is applied to the seal.

The "no spill" drinking cups discussed above, along with other similar cups, have found wide acceptance in the marketplace. The ability of these types of cups to prevent spillage of liquid or at least to minimise spillage when the cup is dropped or knocked over is a significant advantage and convenience. Moreover, some of the cups are promoted as assisting the development of oral and motor coordination that helps to transition children from this type of cup to more general open topped cups.

It is the case however, that spillage from children's drinking cups will occur if the load placed on the seal when the cup is dropped or knocked over is sufficient. Thus, there is room for improving "no spill" drinking cups to increase the integrity of the seal while still allowing ease of drinking by the intended child users. There is also room for providing a cup that requires a different drinking action in order to accommodate children that have difficulty drinking from the existing types of cups discussed above. The present invention is directed to such a cup.

SUMMARY OF INVENTION

According to the present invention there is provided a drinking cup comprising:

- a container and a detachable closure,
- the closure having a connection end for connection to the container, the connection end being open for receipt of liquid from within the container,
- the closure having a closed end opposite the connection end and a drinking rim formed at the peripheral edge of the closed end,
- the closure having a side wall extending between the connection end and the closed end, and at least one opening that facilitates the passage of liquid from within the container to the drinking rim,
- a seal supported by or on the closure and extending around an outside surface of the side wall and sealing the drinking rim against the passage of liquid through the drinking rim, the seal being flexible and being responsive to pressure to lift away from the drinking rim to allow the passage of liquid through the drinking rim for drinking from the cup.

A drinking cup according to the invention includes a seal extending around an outside surface of the side wall rather than a radial seal of the kind disclosed in the prior art discussed above. The side wall can thus be annular and the seal can thus be a circumferential seal or an annular seal. Because the seal is flexible, it can adopt to the shape of the closure about which it extends and so the shape of the closure can be circular, oval, triangular, or even square or rectangular. In general, the closure will be circular or oval, although some recent cup products developed by the applicant have a curved triangular shape and so forms of the invention can have a closure having that shape. Thus, the closure can have three curved walls that meet at three apexes, with the apexes and/or the walls being curved. It is considered that benefits flow from the adoption of a seal of the above kind as compared to a radial seal, at least in terms of the sealing pressure that can be achieved while still allowing for the passage of liquid past the seal under loads that can easily be applied by children and other potential users.

For the seal to seal against the passage of liquid through the drinking rim, the seal can engage a portion of the drinking rim and extend over the opening that facilitates the passage of liquid from within the container to the drinking rim. By this arrangement, the liquid from within the container can flow to the drinking rim, but not pass through the rim.

In some forms of the invention, the seal can seal against the exit of the opening to prevent flow through the opening. In other forms of the invention, the seal is spaced from the exit of the opening but seals against the rim so that flow through the opening is not prevented, but flow past the drinking rim is prevented. In this latter form of the invention, the rim will have a surface for engagement by the seal. In some forms of the invention, the opening will be immediately below that surface. Alternatively, the opening can be spaced from or remote from the surface. The surface can be an annular surface.

A drinking cup according to the invention can have various forms. In one form, the seal can be responsive to suction pressure in order to lift away from the drinking rim, so as to allow the passage of liquid past the drinking rim. In this form of the invention, the seal is lifted away from the rim simply by the action of a child applying a sucking motion or pressure to the rim which is of a sufficient pressure to cause the seal to lift away from the rim. With that suction pressure having been applied, liquid can flow from the container through and past the rim and into the child's mouth.

While suction pressure can be the sole load that can displace the seal from sealing the drinking rim, the applicant has discovered a further construction that assists movement of the seal and that construction allows for the bottom lip of the child to bear against the seal and to cause the seal to flex. Suction pressure can assist that flexing movement, but even without suction pressure, there will be flexing of the seal when the bottom lip presses against the seal.

The above construction can be provided by a section of the seal being spaced from engagement with the outside surface of the side wall of the closure. By this spacing, a void is formed between the seal and the outside surface of the side wall so that lip pressure applied to the section over the void causes the seal to flex inwardly and to lift away or to displace from the drinking rim to allow passage of liquid through the rim. Effectively, the seal is formed into a concave shape by the inward lip pressure, so that a portion, such as a middle portion, of the seal moves inwardly and sections of the seal on either side of that portion, such as the top and bottom edges of the seal, tend to shift outwardly. However, the bottom section of the seal can be captured against that movement so that only the top edge of the seal shifts. The shifting movement of the top edge of the seal can be movement of the seal lifting away from or displacing from the drinking rim to allow passage of liquid. It is to be noted that the pressure applied to the seal by the bottom lip is applied at just one point or section of the seal and so the lifting or displacing movement of the seal occurs at that one point or section. That is, the pressure applied to the seal by the bottom lip does not cause lifting or displacing movement of the entire length of the seal. Each of the outside surface of the side wall, the seal and the void can be annular so that it is an annular section of the seal that is spaced from engagement with the outside surface of the side wall of the closure to form the void.

For the above form of the invention, the seal can be described as having proximal and distal engagement with the closure and the portion of the seal which is spaced from engagement with the outside surface of the side wall is the section between the proximal and distal engagement. It is that section that overlies the void discussed above and it is the inward pressure applied to that section of the seal which results in inward flexing of the seal in the region of the void and lifting or displacing movement of the adjacent seal portion.

The closed end of the closure and the side wall terminate at a drinking rim. The opening of the closure can be adjacent the closed end of the closure and can extend through the drinking rim. The opening can be formed in the side wall adjacent the closed end of the closure, or the side wall can terminate adjacent the closed end to form the opening.

A significant advantage of the above forms of the invention, is that a child drinking from the cup will place their bottom lip in the region of the void and thus will naturally apply inward lip pressure to the seal. It is expected that there will be no need for the child to learn this process, but rather, it will come naturally to the child.

A major benefit of the above arrangement is that because inward lip pressure is used to displace the seal, lifting movement of the seal is not reliant on suction pressure only. It is therefore expected that the seal that is made against the passage of liquid through the drinking rim can be of a higher pressure than the seals made in prior art cups and thus the expectation is that a cup according to the invention will provide greater security against spillage or leakage from a cup which is dropped or knocked over.

The seal can be formed from any suitable material. It is expected that ordinarily, the seal would be formed from a flexible polymer, such as silicone or thermo plastic elastomers.

The seal can be connected to the closure at any suitable point or region, but a suitable connection point is to the closure adjacent to the connection end of the closure. The connection can be a detachable connection. The closure can thus include a radially outwardly facing recess adjacent the connection end and the seal can include one or more projections, including an annular projection, that is removably received within the recess, such as an annular recess. Because of the flexible nature of the seal, the projection can be flexed or stretched to enter the recess and thereafter, the natural resilience of the seal will retain it within the recess.

Alternatively, the closure can include a radially outwardly extending projection adjacent the connection end and the seal can include a projection removably attached to the closure and in nesting engagement adjacent the projection. The radially outwardly extending projection can be an annular projection and the seal projection can be an annular projection.

In some forms of the invention, an O-ring seal is located in a space between the connection end of the closure and a facing surface of the container to seal against leakage of liquid from within the container past the connection between the closure and the container. In alternative forms, the seal of the drinking cup can engage the closure and the container adjacent the connection end so that a separate O-ring is not required. The seal can, for example, be sandwiched between facing surfaces of the closure and the container. The seal can also have a wedge or chamfered surface for engagement with the container so that engagement tends to force the seal into sealing engagement with the facing surfaces of the closure and the container.

Alternative to a detachable connection, the seal can be co-moulded with the container to extend from the container. Thus, the seal can be co-moulded with the container such as at the open end of the container, either at the edge or rim of the container, or at the inner or outer surface of the container in the region of the open end of the container. The materials of the seal and the container can be of the same or different materials, with it to be more likely that they are of different materials. The seal for example, is likely to be of a more flexible material than the container.

The co-moulded seal and container thus become one piece. This differs from the detachable connection in which the seal is not permanently connected to either of the closure or the container. To remove the closure, the seal needs to be released from sealing against the drinking rim and this can be achieved by folding the flexible seal over itself. The closure is then free to be disconnected from the container. Alternatively, the closure can be disconnected from the container with the seal still sealing against the drinking rim, as long as the sealing friction between the seal and the drinking rim can be overcome. To assist this, the closure can include a finger grip that allows the closure to be turned or pulled as required. Such a finger grip can be a rib or the like that is formed on the outside surface of the closed end of the closure, such as centrally of the closure.

As discussed above, the opening of the closure can be positioned adjacent the closed end and the seal can extend to a position in which it is in sealing engagement with a side edge of the closed end. Where a void is formed for inward deflection of the seal, the closed end can form a lip, such as an annular lip, that overlies the side wall and the side wall can include a lateral extension, such as an annular extension, which is spaced from but adjacent the lip. The opening can be formed between the lip and the lateral extension. The radial extent of the lip and the lateral extension can be the same, or the lateral extension can be shorter radially than the lip.

To facilitate lifting or displacing movement of the seal, the seal can include a groove that forms a hinge or a weakness in the seal about which the seal can deflect, pivot or flex. The groove thus forms a weakened section in the seal and deflecting, hinging or pivoting movement about the weakened section facilitates the sealing disengagement from the drinking rim which is required for the passage of liquid from the container through the drinking rim. The groove preferably is formed in a section of the seal that below the lateral extension discussed above, or alternatively, that is on the side of the lateral extension toward the connection end of the closure.

Where the closure includes a void of the kind discussed above, the arrangement can be that liquid passes into the void on its path to the drinking rim. Alternatively, where the opening is adjacent the closed end of the closure, the possibility exists that liquid that passes through the opening for drinking by a child, might leak into the void. For both arrangements, forms of the invention can include a return drain so that liquid that enters the void can return to within the container. The drain can be one or more openings through the side wall of the closure and these openings are preferably provided adjacent the connection end of the closure. An annular array of drain openings can be provided through the side wall.

Where the closure includes a void of the kind discussed above and the arrangement is that liquid passes into the void on its path to the drinking rim, the return drain discussed above can be employed as a liquid inlet to facilitate entry of liquid into the void for travel to the drinking rim. The liquid inlet in this embodiment can be a larger opening than the return drain of the earlier embodiments to facilitate sufficient flow of liquid into the void for consumption.

In the above embodiment, the drinking rim can include a plurality of spaced apart ribs which are spaced apart equidistantly about the inside of the rim, so that flow passageways for flow of liquid are formed or created between adjacent ribs. There could be up to 20 or more ribs spaced about the rim. The drinking rim of the closed end can form or include a lip that overlies the side wall and the plurality of spaced apart ribs can extend from an inside or inner surface of the lip. The flow passageways in this arrangement replace the opening that is formed in the drinking rim of the earlier embodiments. This arrangement still employs a seal that seals against the drinking rim of the container, but in this arrangement the seal is operable to close the open or outlet ends of the passageways to prevent flow of liquid through the passageways. The seal thus seals against the drinking rim in a manner that prevents flow of liquid past the drinking rim until inward lip pressure or suction pressure is applied to the drinking rim. When inward lip pressure or suction pressure is applied to the drinking rim, the seal is displaced from a sealing position against or overlying the open or outlet ends of the passageways between the ribs and flow of liquid can occur through the passageways. Flow of liquid in this arrangement takes place from within the container, then through the liquid inlet and into the void and then out through the passageways between the ribs past the seal.

Once the inward lip pressure or suction pressure is released, the seal will reseal against the drinking rim to close the open or outlet ends of the passageways of the drinking rim and any liquid remaining in the void V can drain back into the body of the container through the inlet acting now as a return drain.

Displacement of the seal from a sealing position with the drinking rim, can be by the seal flexing away from the drinking rim but remaining in contact with lower edges or surfaces of the ribs. The lower edges or surfaces of the ribs can present a fulcrum about which pivoting or flexing movement occurs. The seal thus flexes away from the drinking rim to expose the open or outlet ends of the passageways between the ribs.

Drinking cups according to the invention can include an outer ring that is shiftable between drinking and non-drinking modes. In the non-drinking mode, the ring will overlie the seal and will bear against the seal at least in the region of the seal that seals against the passage of liquid through the drinking rim. Beneficially, this provides resistance to lifting of the seal and so provides for improved security or certainty in relation to the prevention or minimisation of leaks and spillage.

In the drinking mode, the ring is positioned to expose the seal, at least in the region of the seal that seals against the passage of liquid through the drinking rim, so that the application of pressure to the seal can be made as described above.

Movement of the ring between the non-drinking and drinking modes can be by rotation of the ring relative to the container and this can be achieved by including one or more threads on an internal surface of the ring for interaction with an equivalent number of projections or cams that project either from the container or closure and whereby rotation of the ring causes the threads to ride along the cams or projections to lift or lower the ring. Other arrangements to move the ring between the non-drinking and drinking modes can be employed. For example, the ring could be arranged for vertical movement without rotation.

While the ring can bear against the seal in the non-drinking mode, in alternative forms of the invention, the ring actually applies pressure to the seal at least in the region of the seal that seals against the passage of liquid through the drinking rim. In this form of the invention, the seal is positively pushed into sealing engagement with the drinking rim, so further increasing the likelihood of containing leakage or spillage.

In the drinking mode, an upper edge of the ring can overlap or overlie a lower edge of the seal. By this arrangement, in the drinking mode, the ring does not move to a position in which its upper edge is spaced below the lower or bottom edge of the seal. That is, the upper edge of the ring always overlies the seal, at least at the lower edge of the seal. This arrangement prevents the upper edge of the ring from catching on and jamming against the lower edge of the seal if the seal becomes dislodged or warps and enters the path of movement of the ring from the drinking mode to the non-drinking mode. While this arrangement provides a benefit in preventing the ring from catching on the seal, if the seal becomes dislodged or warps, if the overlap is sufficient, i.e. 3-5 mm between the upper edge of the ring and the lower edge of the seal, the ring advantageously forms an impediment to removal of the seal from the closure when drinking cup is fully assembled, as the ring effectively locks the lower edge of the seal between the ring and the facing wall of the closure.

The closed end of the closure can be concave when viewed from outside of the drinking cup and it can also or alternatively be transparent so that the contents of the cup are visible through the closed end and so that the closed end forms a window into the cup for observing the contents of the cup. The benefit of this is that it allows the user to see into the cup while drinking, thus providing a visual indication of liquid level and cup tilt which is similar to drinking from a regular or standard open top cup, but without the potential for liquid spilling from the cup, such as into the user's face if the cup is tilted back too far. The prior art arrangements discussed above are not constructed in a manner that facilitates a transparent closure that can act as a window into the cup.

Drinking cups according to the invention can include a one-way valve installed in the closed end of the closure to allow liquid to be fed into the drinking cup to conveniently top-up or refill the cup, but to prevent leakage of liquid out of the cup. This arrangement means the drinking cup can be topped-up or refilled without the closure being removed from the container.

BRIEF DESCRIPTION OF DRAWINGS

In order that the invention may be more fully understood, some embodiments will now be described with reference to the figures in which.

DETAILED DESCRIPTION

Figure 1:
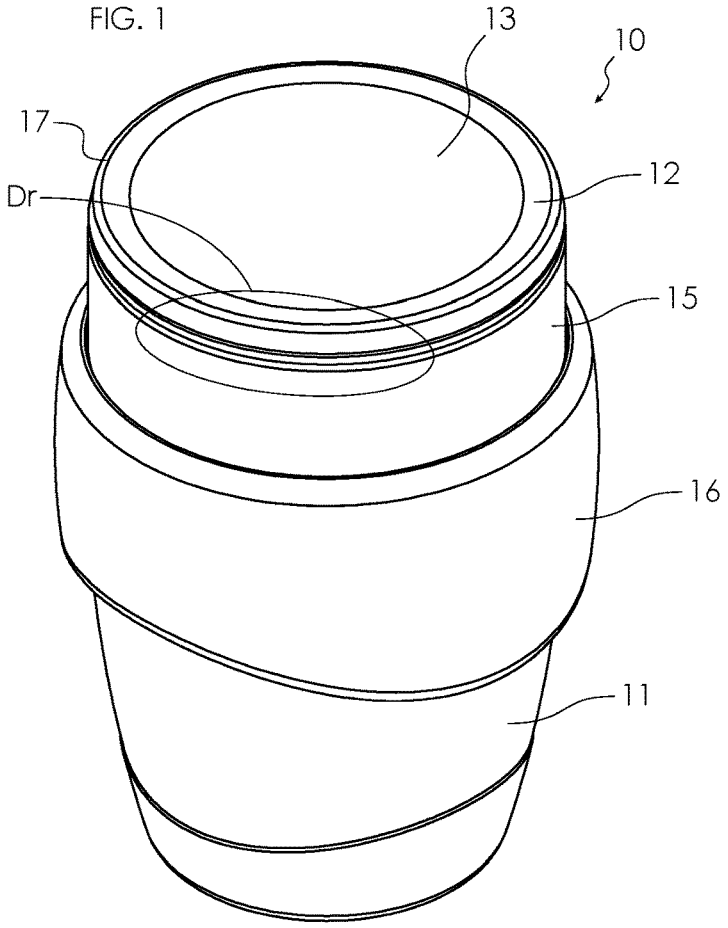
FIG. 1 is a perspective view of a drinking cup according to one embodiment of the invention with the cup in a drinking mode.

FIG. 1 is a perspective view of a drinking cup 10 according to one embodiment of the invention. The drinking cup 10 includes a container 11 and a detachable closure 12. The closure 12 connects to an upper end of the container 11 and is detachable for the purpose of introducing and removing liquid from the drinking cup 10 and for cleaning purposes.

The closure 12 has a closed end 13. The closure 12 further has an annular side wall 14, which is illustrated as an annular side wall, although in FIG. 1, the side wall 14 is obscured by a seal 15, which is also annular and that is supported on the closure 12 and extends around the side wall 14 to overlie the side wall 14. This will be described in more detail in relation to FIG. 3.

Figure 2:
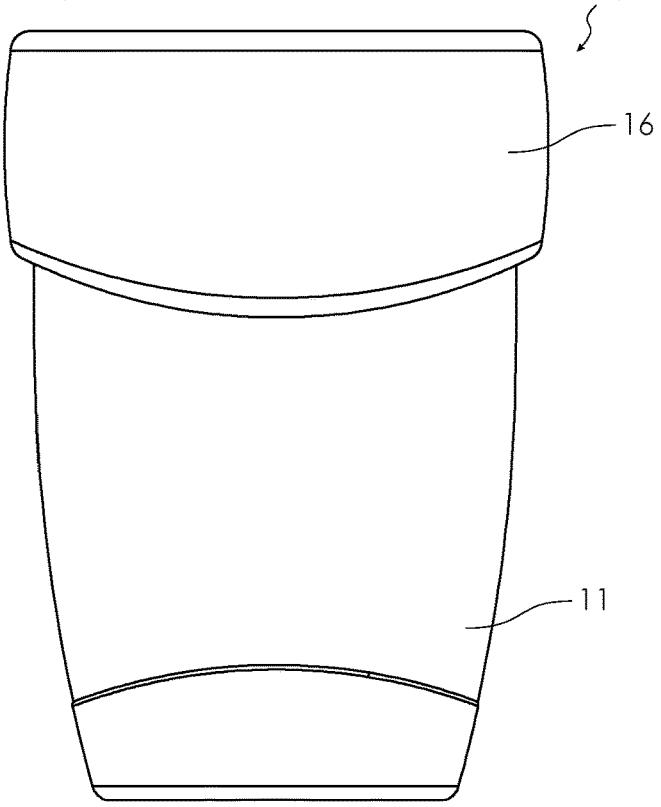
FIG. 2 is a side view of the drinking cup of FIG. 1 with the cup in a non-drinking mode.

The drinking cup 10 further includes an outer ring 16 that is movable by rotation between a drinking mode or position which is shown in FIG. 1, and a non-drinking mode or position which is shown in FIG. 2. Thus, in FIG. 2, the ring 16 is raised relative to the container 11, whereas in FIG. 1, the ring 16 is lowered, so that in FIG. 1, the closure 12 and the seal 15 are exposed.

Drinking from the cup 10 occurs at the drinking rim 17 as will become evident later herein.

Figure 3:
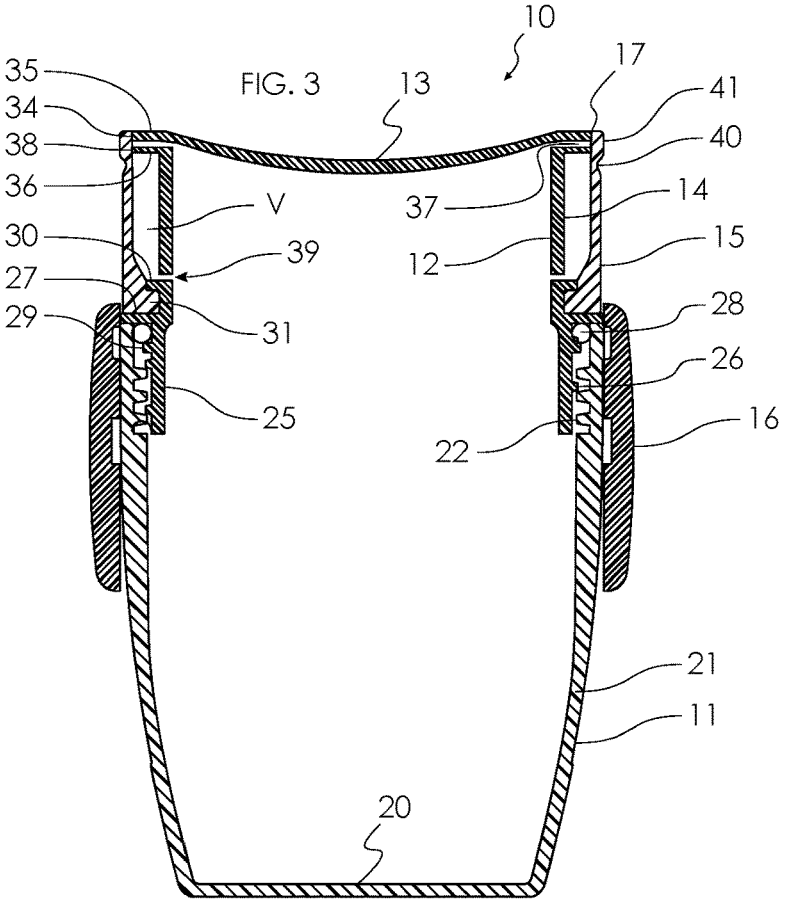
FIG. 3 is a cross-sectional view of the cup illustrated in FIG. 1.

FIG. 3 is a cross-sectional view of the drinking cup 10 with the ring 16 in the lowered or drinking mode. From FIG. 3, it can be seen that the container 11 has a flat base 20 and an upstanding cylindrical side wall 21. The side wall is tapered as shown from the base 20. Remote from the base 20, the side wall includes an inwardly facing thread 22. The side wall 21 terminates at an upper edge 23.

The closure 12 has a connection end 25 that includes an outwardly facing thread 26 for threadably connecting the connection end 25 to the upper edge of the side wall 21. The closure 12 further includes a lateral extension 27 which bears against the upper edge 23 of the container 11 when the closure 12 is fully engaged with the side wall 21. An O-ring seal 28 is captured between an under surface of the lateral extension 27 and an annular projection 29. The O-ring seal 28 bears against an inwardly facing surface of the side wall 21 adjacent the upper edge 23, when the lateral extension 27 is in engagement with the upper edge 23, so that when the closure 12 is fully connected to the container 11, the O-ring seal 28 thus prevents flow of liquid within the container 11 past the connection between the connection end 25 and the upper edge 23.

The seal 15 is flexible and elastic and is preferably made of a food grade polymer such as silicone or thermo plastic elastomers. The seal 15 is detachably supported on the closure 12. For this, the closure 12 defines a radially outwardly facing recess R (see FIGS. 7 and 8) formed between the lateral extension 27 and a further lateral extension 30. The seal 15 includes an annular projection 31 that extends into the recess R and secures the seal 15 to the closure 12. The seal 15 can be flexed or stretched to enter the recess R and thereafter, the natural resilience of the seal 15 will retain it within the recess R.

Figure 9:
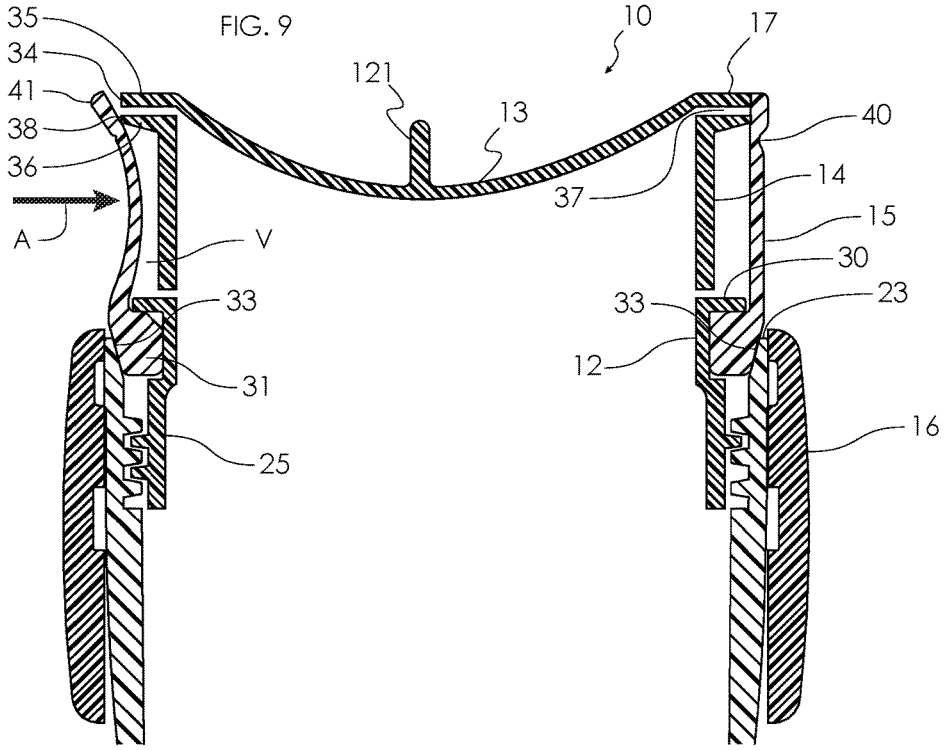
FIG. 9 is a cross-sectional view of an upper portion of a drinking cup according to another embodiment of the invention.

The arrangement shown in FIG. 9 differs from the earlier figures and shows a cross-section of the top portion of the drinking cup 10 but with the lateral extension 27 removed so that only a very shallow recess remains. In this arrangement, the annular projection 31 of the seal 15 bears directly against the side wall 21 adjacent the upper edge 23 of the container) 1. As shown in FIG. 9, cooperating surfaces 33 of the side wall 21 and the annular projection 31 are chamfered so that as the closure 12 is threaded onto the container 11, the respective chamfered surfaces 33 engage and push the projection 31 into the shallow recess for firm sealing engagement of the projection 31 with the facing surface of the recess. Otherwise the arrangement of FIG. 9 is the same as the earlier figures.

The seal 15 extends upwardly to the closed end 13 and engages against a side edge 34 of the closed end 13. In this respect, the closed end 13 forms an annular lip 35 that overlies the side wall 14, while the side wall includes a lateral extension 36 which is spaced from but adjacent the lip 35. The lip 35 and the extension 36 form part of the drinking rim 17. As shown in FIG. 3, the spacing between the lip 35 and the lateral extension 36 forms an opening 37 which is adjacent the closed end 13 and which facilitates the passage of liquid from within the container 10. The opening 37 is an annular opening, although it will be appreciated that a plurality of connectors will extend between facing surfaces of the lip 35 and the lateral extension 36 to connect the closed end 13 to the side wall 14 in the spaced manner described above. The opening 37 can thus in some forms of the invention comprise a plurality of smaller or separate openings.

It will be evident from FIG. 3 that the seal 15 overlies the opening 37 and sealingly engages the side edge 34 of the lip 35. As shown in FIG. 3, the seal 15 can also engage the side edge 38 of the lateral extension 36 although this is not essential. If the seal 15 does not engage the side edge 38, liquid can flow through the opening 37 and into the void V, but the liquid is prevented from flowing through the drinking rim 17 by the seal 15 engaging with the edge 34. This sealing engagement between the seal 15 and the side edges 34 and 38 (or just the side edge 34) is via radial pressure exerted by the seal on the respective side edges 34 and 38 and the seal pressure can be selected by selecting the material from which the seal 15 is formed, and by the diameter of the seal in the region of the side edges 34 and 38. Accordingly, the seal can be either a tight seal, or a loose seal, or somewhere in between. Where liquid flows into the void V, the side wall 14 can include a drain opening 39 for the passage of that liquid back into the container 11.

It will further be evident from FIG. 3, that liquid can pass through the drinking rim 17 for drinking purposes, by applying pressure to the seal 15 in the region of the lip 35 of the closed end 13 in order to lift the seal away from the side edge 34 of the lateral extension 35 so as to allow the passage of liquid through the opening 37 and through the drinking rim 17. Thus, and with reference to FIG. 1, a child drinking from the cup 10 might engage the cup 10 at the region of the drinking rim 17 circled in FIG. 1 and marked Dr ("drinking region") by lip engagement and by applying a suction pressure, the seal 15 will lift, flex or pivot away from the side edge 34 so the liquid can flow through the opening 37 through the drinking rim 17 and into the mouth of the child. To facilitate this lifting, pivoting or flexing movement, the seal 15 can include an annular groove or recess 40, which forms a weakened region in the seal 15 and which can form a hinge, about which the upper annular end 41 of the seal 15 can flex or pivot. As shown in FIG. 3, the annular groove is formed in the seal below the lateral extension 36 and is therefore on the side of the lateral extension 36 toward the connection end 25 of the closure 12.

It will be appreciated that a child can drink from the cup 10 from any point about the drinking rim 17, or about the circumference of the closed end 13. Thus, while the drinking region Dr is shown in FIG. 1, this is simply shown as a portion of the drinking rim 17 of the closure 12 at which a child might approach the cup 10. Beneficially, the child using the cup 10 can sip from the cup 10 at any region of the rim 17, so that the child is not required to adopt a particular orientation of the cup 10, other than to bring the rim 17 of the cup 10 to his or her lips.

Figure 4:
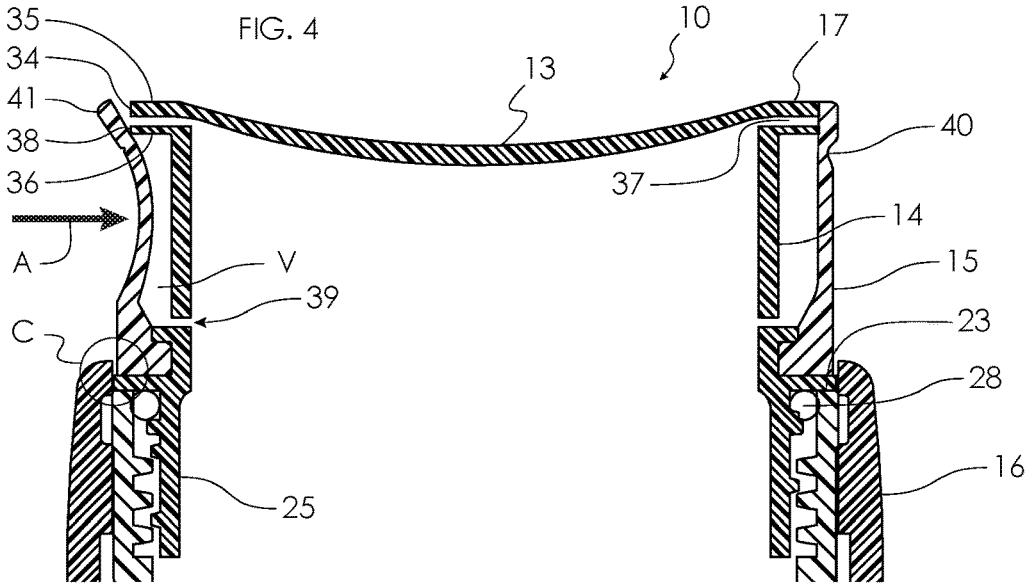
FIG. 4 is a detailed view of an upper portion of the drinking cup showing the state of the cup during a drinking event.
Figure 5:
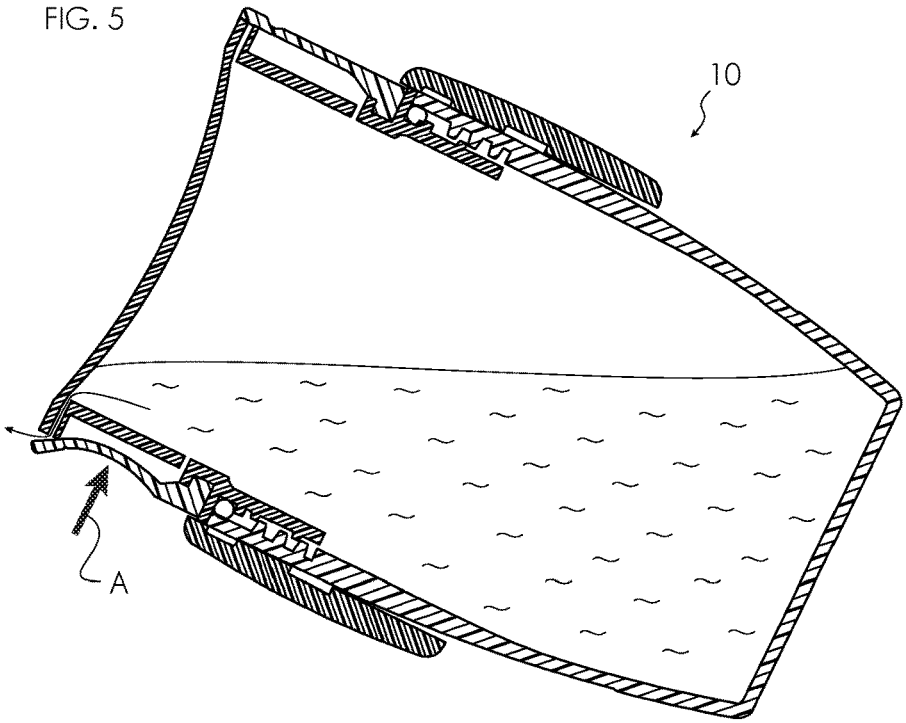
FIG. 5 is a view of a cup in drinking mode during a drinking event and being tilted.

While suction pressure can be used to displace the upper end 41 of the seal 15 away from the opening 37 for the purpose of drinking from the cup 10, the applicant has discovered that the provision of an annular void V between the side wall 14 of the closure 12 and the seal 15, can assist the ease with which drinking from the cup 10 can be undertaken, but without compromising the sealing effect of the seal 15 with the drinking rim 17 when the cup 10 is dropped or knocked over. The void V is formed between the projection 31 and the upper end 41 of the seal 15 and the void V advantageously allows the seal 15 to be pushed inwardly by the bottom lip of a child drinking from the cup 10 which naturally causes the seal 15 to bow, and which naturally forces the upper end 41 of the seal 15 to shift away from the side edge 34 of the lateral extension 35. This mechanism is illustrated in FIG. 4 and with the arrow A illustrating the load that is applied to the seal 15 between the projection 31 and the upper end 41, such as by the bottom lip of a child drinking from the cup 10. With reference to FIG. 4, it can be seen that the seal 15 pivots or flexes about the side edge 38 of the lateral extension 36, so that the side edge 38 becomes a fulcrum about which pivoting or flexing movement occurs. As will be seen from FIG. 4, liquid can thus flow from within the container 11 and up through the opening 37 and out past the lip 35 and the upper end 41 of the seal 15. Of course in use, the child would be tipping the cup 10 so that liquid actually flowed to the inlet or mouth of the opening 37 and the tipped form of the invention is shown in FIG. 5.

The use of a void V as described above in relation to the present invention has enabled the seal 15 to be applied with greater load to the closure 12, so that if the drinking cup 10 is dropped or knocked over, there is an improved likelihood that leakage or spillage through the drinking rim 17 will be contained. However, a child drinking from the cup 10 is not required to exert greater suction load to draw liquid from within the container 11, because the bottom lip of the child can press the seal 15 in the manner shown in FIGS. 4 and 5 to force the upper end 41 of the seal away from the side edge 34 of the lateral extension 35 and to expose the exit of the opening 37. Thus, by a combination of suction pressure and bottom lip pressure on the seal 15, the seal 15 is displaced in the manner shown and liquid can pass through the opening 37 and thus through the drinking rim 17 for drinking by the child.

In the drinking mode of FIGS. 1, 3 and 4, an upper edge of the ring 16 can overlap or overlie a lower edge of the seal 15. This is shown by the circled region C in FIG. 4. This arrangement prevents the upper edge of the ring 16 from catching on and jamming against the lower edge of the seal 15 if the seal 15 becomes dislodged, for example by the projection 31 shifting out of the recess R, or if the seal 15 warps. This arrangement thus prevents the ring 16 from catching on the seal 15, but in addition, the ring 16 resists removal of the seal 15 from the closure 12 when drinking cup 10 is fully assembled, by the ring 16 preventing removal of the projection 31 from the recess R.

Figure 6:
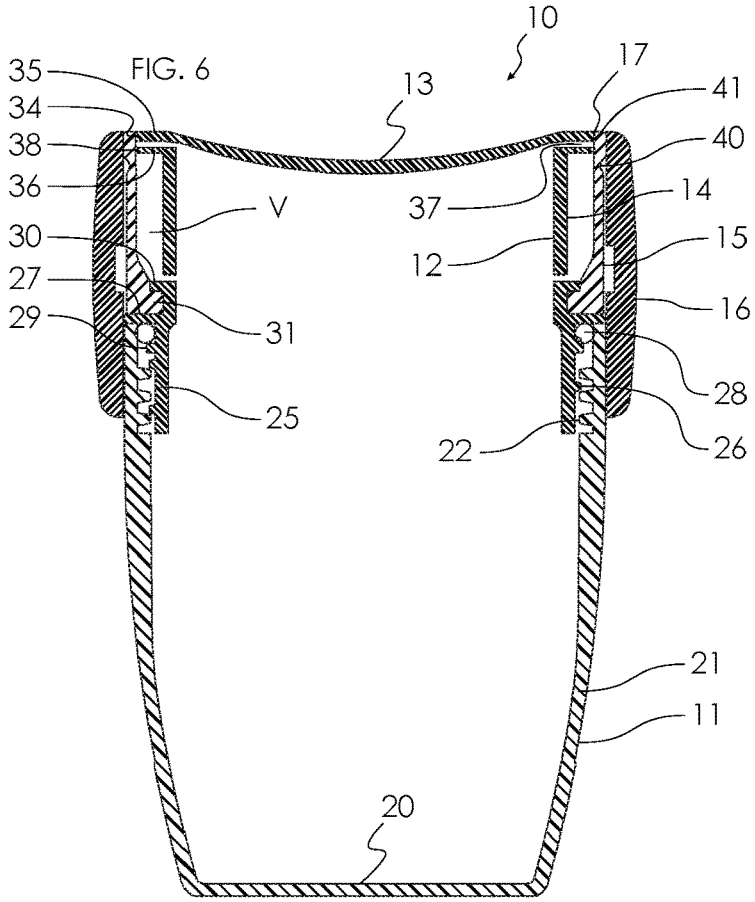
FIG. 6 is a cross-sectional view of the cup illustrated in FIG. 1 in a non-drinking mode.

FIG. 6 is a cross-sectional view of FIG. 2 and thus shows the outer ring 16 in the non-drinking mode or position discussed above. Thus, the outer ring 16 has been rotated upwardly so that the ring 16 overlies the seal 15. Importantly, the ring 16 bears against the upper end 41 of the seal 15 that overlies the opening 37. This bearing engagement can be of a level that simply resists the upper end 41 of the seal 15 lifting away from the side edge 34 of the lateral extension 35, or it can actually exert pressure on the upper end 41 so as to positively push the upper end 41 into engagement with the side edge 34. In either case, the ring 16 serves to improve the likelihood that leakage or spillage from the cup 10 will not occur when the cup 10 is dropped or knocked over, and when the ring 16 is in the non-drinking mode or position. This mode or position can be adopted for example, at all times other than when drinking from the cup is intended. Thus, if the cup is resting on a table, or is being carried in a bag, or if it has been filled but it is not yet time to give it to the child, the ring can be in the upper, non-drinking mode. This mode is particularly advantageous when the cup is being moved in a bag or the like, as the cup can easily tip over and present a slippage or leakage opportunity.

Figure 7:
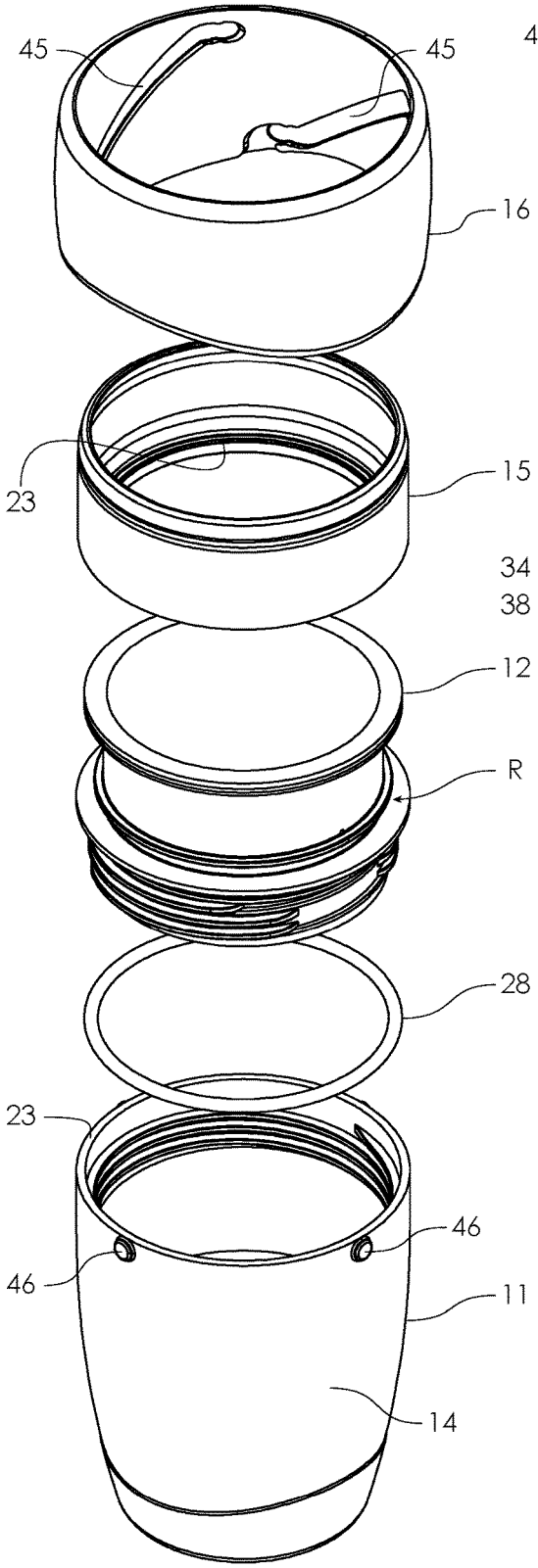
FIGS. 7 and 8 are perspective and cross-section exploded views of the drinking cup of FIG. 1.
Figure 8:
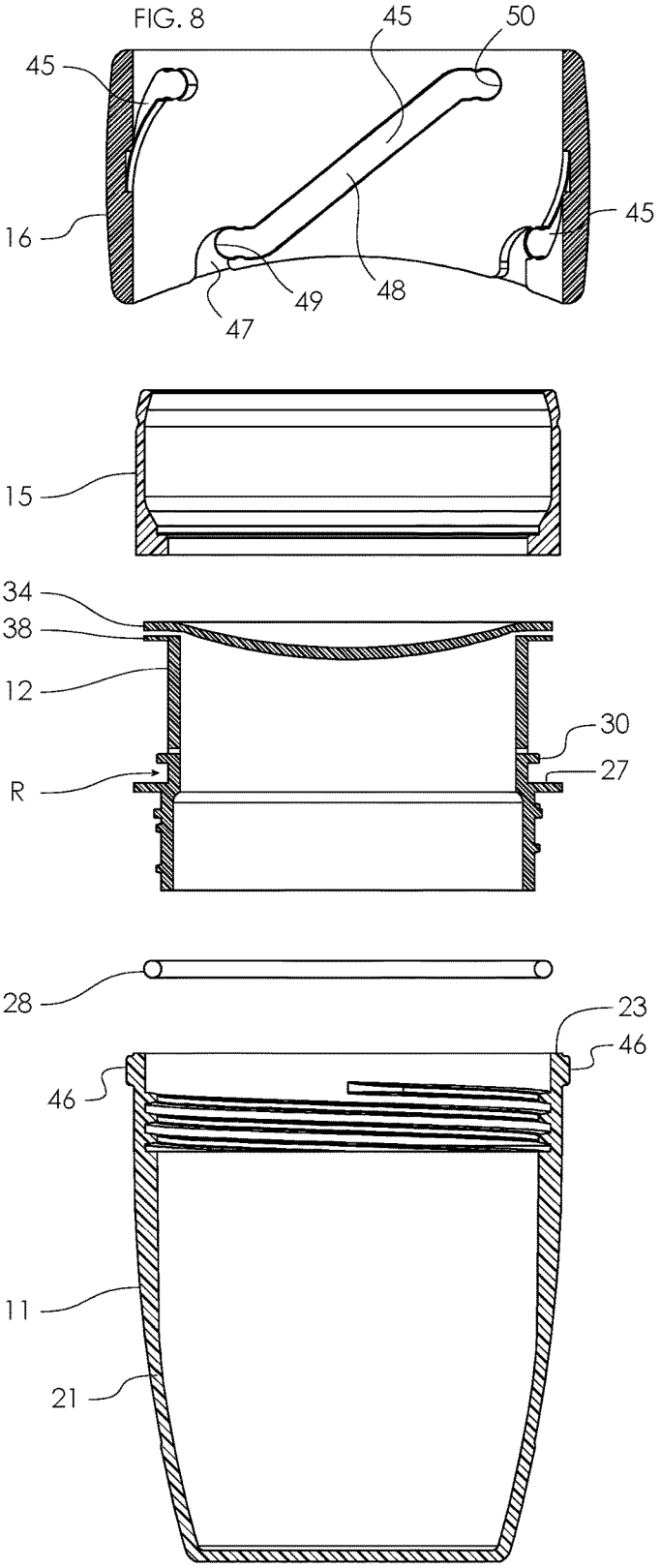

The ring 16 can be moved between the drinking and non-drinking modes via a coarse thread applied to its inside surface. FIGS. 7 and 8 are respectively exploded perspective and cross-sectional views of the cup 10 and those views show each of the features of the cup 10 that have been described hereinbefore, but also show a multi-start thread 45 applied to the inside surface of the ring 16.

The threads 45 are arranged for receipt of cams or projections 46 that project outwardly from the outside surface of the container 11 just below the upper edge 23. The threads 45 are formed to have an entrance opening 47, a main travel portion 48, an end abutment 49 and an end stopper 50.

The ring 16 can be applied to the cup 10 when all other components of the cup 10 have been assembled. Thus, the ring 16 can be connected as the last component of the cup 10. Alternatively, the ring can be applied to the container 11 prior to the closure 12 being connected. Either way, to attach the ring 16 to the cup 10, the ring 16 is aligned with the cams 46, so that they enter the entrance openings 47 of the threads 45. The entrance openings 47 have a relatively shallow depth and there is a transition to a greater depth past the end abutment 49. It is therefore necessary to apply a force to the ring 16 for the cams 46 to enter the entrance openings 47 and for a slight twisting or rotating motion to be applied to the ring 16 to cause the cams to move past the end abutment 49 and into the main travel portion 48.

The difference in depth between the entrance opening 47 and the main travel portion 48 creates the end abutment 49, which can be formed as a curved wall or step that transitions between the greater depth of the travel portion 48 and the reduced depth of the opening 47. The abutment 49 thus forms a tactile indicator for a person using the cup 10 to indicate when the ring 16 has been rotated to the lowered and non-drinking position. The person turning the ring will note a resistance to further rotation when the cams 46 engage the abutment 49. However, with increased effort, further rotation of the ring 16 can be achieved so that the cams ride over the end abutment 49 and into the entrance opening 47, whereafter the ring 16 can be lifted upwardly and completely off the cup 10, such as for cleaning purposes.

The stopper 50 is intended to present an abutment at which point no further rotation of the ring 16 can be made other than to commence reverse rotation. Accordingly, with the ring 16 in the non-drinking position, in which the cams 46 are in contact with the end abutment 49, the ring can be rotated to bring the cams up through the main travel portion 48 and into engagement with the stopper 50. Once engagement with the stopper 50 occurs, there will be a tactile indication that no further rotation of the ring 16 can be made or is required and that the ring is now in the drinking position.

The engagement between the cams 46 and the threads 47 can be frictional so that in each of the drinking and non-drinking positions, the ring retains its position.

The closed end 13 of the closure 12 can be transparent so that the contents of the cup are visible through the closed end 13 and so that the contents of the cup 10 can be observed through the closed end 13. The benefit of this as stated earlier herein, is that it allows the user to see into the cup 10 while drinking, thus providing a visual indication of liquid level and cup tilt which is similar to drinking from a regular or standard open top cup, but without the potential for liquid spilling from the cup, such as into the user's face if the cup is tilted back too far.

FIG. 7 in particular illustrates the components of the cup 10 and from that figure, it will be evident as to the simplicity of the cup 10. Thus, to assemble the cup 10, it is necessary to locate the O-ring seal 28 on the closure 12 and to then thread the closure 12 into engagement with the upper end of the side wall 14. The next step is to flexibly apply the seal 15 to the closure 12 and to ensure that the projection 31 of the seal 15 enters the recess R of the closure 12. With the projection 31 captured within the recess R, the seal 15 will be properly mounted on the closure 12, about the outside surface 14 and will overlie the annular opening 37 and will sealingly engage the side edge 34 of the lateral extension 35. The ring 16 can thereafter be lowered over the closure 12 to align the entrance openings 47 of the ring 16 with the cams 46 and to rotate the ring 16 to either the drinking position of FIG. 3, or the non-drinking position of FIG. 6. Alternatively, the cup 10 can be assembled by placing the ring 16 on the container 11 prior to the closure 12 being connected to the container 11. The seal 15 can be applied to the closure 12 and then the closure 12 can be connected to the container 11. The ring 16 can thereafter be moved to the non-drinking position. Disassembly can occur in the reverse manner and disassembly is equally simple and therefore the cup 10 is readily cleanable without difficulty.

Figure 10:
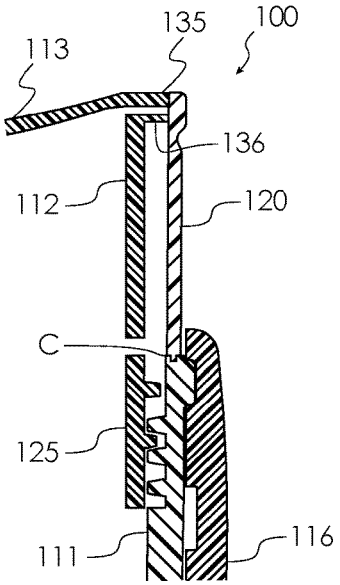
FIGS. 10 to 12 are detailed cross-sectional views of an upper side portion of a drinking cup according to another embodiment of the invention.
Figure 11:
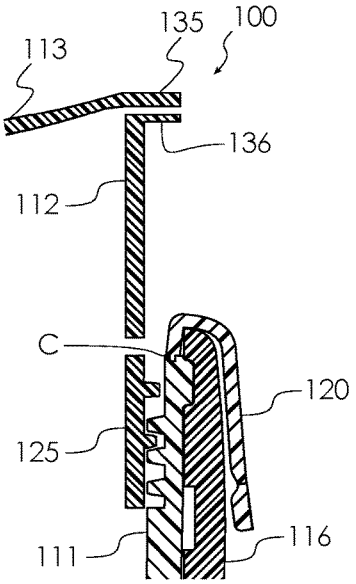
Figure 12:
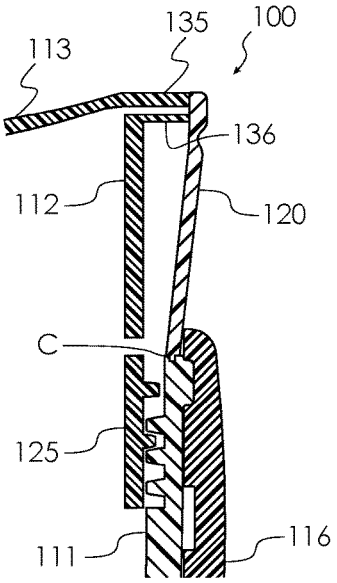

In a further alternative of the invention, the seal can be co-moulded with the container rather than detachable as described above. This is illustrated in FIGS. 10 to 12 which are cross-sections of one side portion of a drinking cup which has a similar configuration to the drinking cup 10 of the earlier figures. The same parts are therefore given the same reference numerals, plus 100.

The seal 120 of the drinking cup 100 is co-moulded with the container 111 at the co-mould join C, which, as shown is as at the upper edge or rim of the container 111. The material of the seal 120 is of a more flexible material than the container 111. As is apparent in FIG. 10, the co-moulded seal 120 and container 111 become a single integral or integrated component, so that removal of the closure 112 requires the closure 112 to be unthreaded relative to both the container 111 and the seal 120. To do this, either of the arrangements of FIG. 11 or 12 can be adopted.

In FIG. 10, the seal 120 sealingly engages against the lip 135 and the lateral extension 136. This creates a frictional sealing engagement between the seal 120 and the closure 112 that would resist the closure 112 being unthreaded from the container 111. In FIG. 11, the seal 120 is folded over itself to displace the seal 120 from the lip 135 and the lateral extension 136. In this folded over condition, the frictional sealing engagement between the seal 120 and the closure 112 is removed and the closure 112 can be unthreaded relative to the container 111.

In FIG. 12, it is intended that the closure be removed with the seal 120 remaining in sealing engagement with the lip 135 and the lateral extension 136. For this, the seal 120 tapers or drafts outwards from the co-mould join C to make it easier for the user to rotate the closure 112 on the container 111. To assist rotation of the closure 112, a finger grip 121 (see FIG. 9) can be provided to facilitate turning or pulling on the closure 112 in order to overcome the frictional sealing engagement between the seal 120 and the closure 112 to allow the closure 112 can be unthreaded relative to the container 111. Thus, in the FIG. 12 arrangement, the seal 120 does not need to be folded over itself for the closure 112 to be removed.

Figure 13:
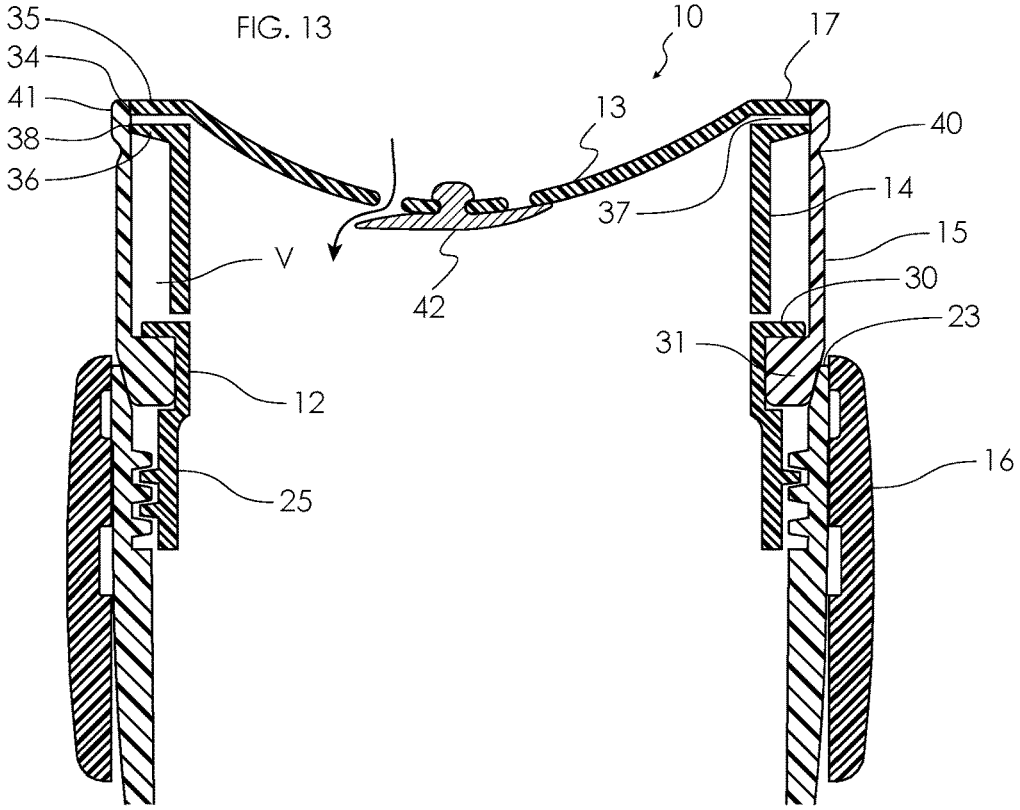
FIG. 13 is a cross-sectional view of the drinking cup of FIG. 9, with a one-way valve inserted in the closure.

FIG. 13 illustrates the arrangement of FIG. 9 but with a one-way valve 122 installed in the closed end 13 of the closure 12 to allow liquid to be fed into the drinking cup 10 to conveniently top-up or refill the cup, but to prevent leakage of liquid out of the cup 10. This arrangement means the drinking cup 10 can be topped-up or refilled without the closure 12 being removed from the container 10.

Figure 14:
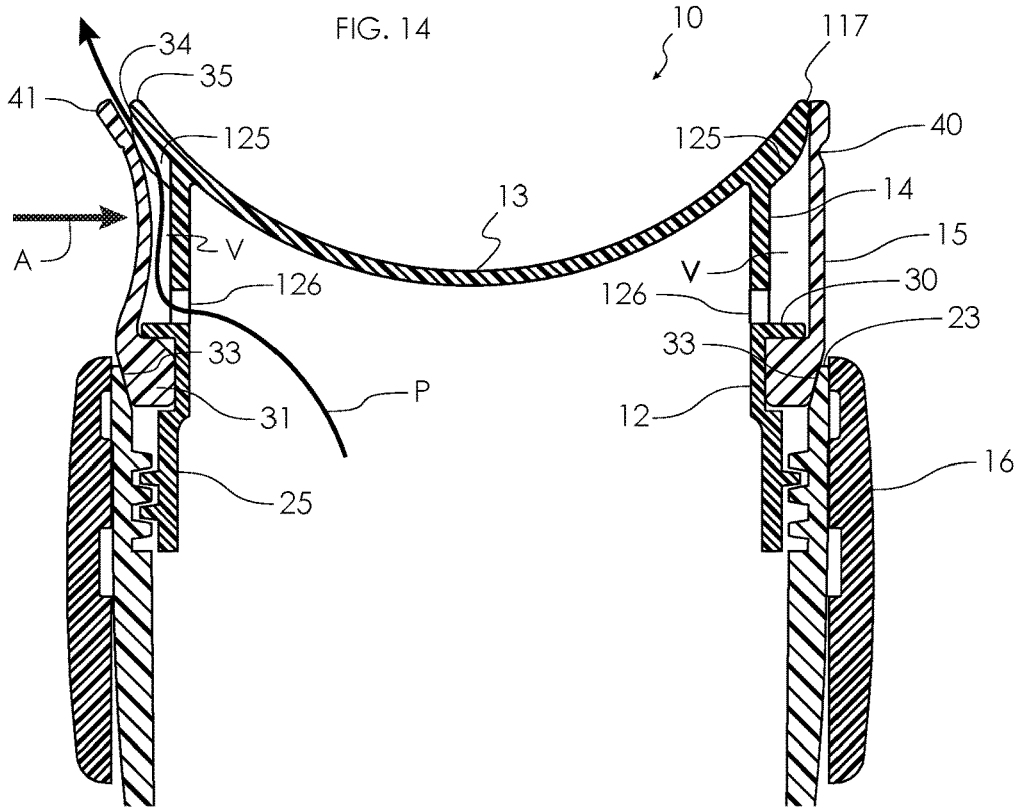
FIG. 14 is a cross-sectional view of an upper portion of a drinking cup according to another embodiment of the invention.

FIG. 14 illustrates the arrangement of FIG. 9 again, but with a modified drinking rim 117. The modified drinking rim 117 includes a plurality of spaced apart ribs 125 which are spaced apart equidistantly about the inside of the rim, so that flow passageways are created between the ribs 125. The flow passageways replace the opening 37 that is formed in the rim 17 of the FIG. 9 arrangement so that flow of liquid in the FIG. 14 arrangement takes place along the flow path P which utilises and enlarged the drain opening 39 of FIGS. 3 and 4 to form an opening 126. The drain opening 126 of FIG. 14 thus forms both an inlet and an outlet to the void V.

The seal 15 seals against the rim 117 as shown on the right-hand side of FIG. 14, but with inward lip pressure as per arrow A applied to opposite and left-hand side of the seal 15 as described in relation to FIG. 4 earlier herein, the upper end 41 of the seal 15 shifts away from a sealing position against the open ends of the flow passageways between the ribs 125 and flow of liquid can occur along the flow path P. As shown on the left-hand side of FIG. 14, the seal 15 pivots or flexes when inward lip pressure or suction pressure is applied to it, but it remains in contact with the inside edge of the ribs 125 during that pivoting or flexing movement, although that is not essential and disconnection of the seal 15 with the ribs 125 is acceptable if sufficient suction pressure is applied. In the illustrated arrangement, the seal 15 pivots or flexes on the edges of the ribs 125 so that the ribs 125 become a fulcrum about which pivoting or flexing movement occurs.

Flow of liquid along the flow path P thus facilitates drinking from the cup 10, and once drinking is finished, the seal 15 will reseal against the rim 117 and any liquid remaining in the void V can drain back into the body of the container 11.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

Those skilled in the art will appreciate that the invention described herein is susceptible to variations and modifications other than those specifically described. It is understood that the invention includes all such variations and modifications which fall within the spirit and scope of the present invention.

The claims defining the invention are as follows:

1. A drinking cup comprising:

a container and a detachable closure, the closure having a connection end for connection to the container, the connection end being open for receipt of liquid from within the container, the closure having a closed end opposite the connection end and a drinking rim formed at the peripheral edge of the closed end, the closure having a side wall extending between the connection end and the closed end, and at least one opening that facilitates the passage of liquid from within the container to the drinking rim, a seal supported by the closure and extending around an outside surface of the side wall and sealing the drinking rim against the passage of liquid through the drinking rim, the seal being flexible and being responsive to pressure to lift away from the drinking rim to allow the passage of liquid through the drinking rim for drinking from the cup.

2. The drinking cup according to claim 1, wherein a section of the seal being spaced from the engagement with the outside surface of the side wall between the connection end and the closed end of the closure to form a void between the seal and the outside surface of the side wall, whereby the seal is responsive to inward lip pressure applied to the seal over the void to flex and lift away from the drinking rim and to allow the passage of liquid through the at least one opening.

3. The drinking cup according to claim 1, wherein the seal having proximal and distal engagement with the closure and being spaced from engagement with the outside surface of the side wall between the proximal and distal engagement to form a void between the seal and the outside surface of the side wall, whereby the seal is responsive to inward lip pressure applied to the seal over the void to flex and lift away from the drinking rim and to allow the passage of liquid through the drinking rim.

4. The drinking cup according to claim 1, wherein the seal is detachably connected to the closure adjacent the connection end.

5. The drinking cup according to claim 4, wherein the closure includes a radially outwardly facing recess adjacent the connection end and the seal includes a projection removably received within the recess.

6. The drinking cup according to claim 4, wherein the closure includes a radially outwardly extending projection adjacent the connection end and the seal includes a projection removably attached to the closure and in nesting engagement adjacent the projection.

7. The drinking cup according to claim 4, wherein the seal sealingly engages the closure and the container adjacent the connection end.

8. The drinking cup according to claim 7, wherein the seal has a wedge or chamfered surface for engagement with the container.

9. The drinking cup according to claim 1, wherein the seal seals the drinking rim against the passage of liquid by sealingly engaging with a side edge of the closed end.

10. The drinking cup according to claim 1, wherein the closed end forms a lip at the drinking rim overlying the side wall and the side wall includes a lateral extension spaced from and adjacent the lip and the at least one opening being formed between the lip and the lateral extension.

11. The drinking cup according to claim 1, wherein the at least one opening is an annular opening.

12. The drinking cup according to claim 1, wherein the closed end forms a lip at the drinking rim overlying the side wall and the lip has a plurality of spaced apart ribs about the inside of the lip and the at least one opening is formed by passageways between adjacent ribs.

13. The drinking cup according to claim 1, wherein the closure includes an opening to return liquid that flows between the seal and the side wall back to into the container, or to allow liquid to flow to a position between the seal and the side wall from the container.

14. The drinking cup according to claim 13, wherein the opening is formed in the side wall adjacent the connection end.

15. The drinking cup according to claim 1, including an outer ring that is shiftable between drinking and non-drinking modes, a. in the non-drinking mode, the ring overlies the seal and bears against the seal at least in the region of the seal that seals against the drinking rim, b. in the drinking mode, the ring is positioned to expose the seal at least in the region of the seal that seals against the drinking rim for the application of pressure to the seal for lifting the seal away from the drinking rim to allow the passage of liquid through the drinking rim for drinking from the cup.

16. The drinking cup according to claim 15, wherein in the non-drinking mode, the ring overlies the seal and applies pressure against the seal at least in the region of the seal that seals against drinking rim.

17. The drinking cup according to claim 15, wherein the ring is shiftable between drinking and non-drinking modes by rotation relative to the container and the detachable closure.

18. The drinking cup according to claim 17, wherein the ring includes a thread on an internal surface and the container or closure includes a cam received within the thread and rotation of the ring causes the thread to ride along the cam and to lift or lower depending on the direction of rotation.

19. The drinking cup according to claim 15, wherein in the drinking mode, an upper edge of the ring overlaps or overlies a lower edge of the seal.

20. The drinking cup according to claim 1, wherein the closed end of the closure is transparent.

* * * * *